United States Patent [19]

Richardson

[11] Patent Number: 4,951,759

[45] Date of Patent: Aug. 28, 1990

[54] OIL WELL RIG WITH PIPE HANDLING APPARATUS

[75] Inventor: Allan Richardson, Calgary, Canada

[73] Assignee: Canrig Manufacturing Ltd., Calgary, Canada

[21] Appl. No.: 361,362

[22] Filed: Jun. 5, 1989

[30] Foreign Application Priority Data

Jun. 9, 1988 [CA] Canada ..... 569089

[51] Int. Cl.[5] ..... E21B 19/15

[52] U.S. Cl. ..... 175/85; 166/77.5; 166/85; 414/22.53; 414/22.55

[58] Field of Search ..... 166/77.5, 85; 175/52, 175/85; 414/22.53, 22.54, 22.55, 22.56, 22.62

[56] References Cited

U.S. PATENT DOCUMENTS 3,280,920 10/1966 Scott ..... 414/22.55
3,633,771 1/1972 Woolslayer et al. ..... 414/22.55
4,303,270 12/1981 Adair ..... 414/22.55 X
4,403,897 9/1983 Willis ..... 414/22.55
4,586,572 5/1986 Myers et al. ..... 414/22.53 X
4,834,604 5/1989 Brittain et al. ..... 414/22.55

*Primary Examiner*—Stephen J. Novosad
*Attorney, Agent, or Firm*—Zarley McKee, Thomte, Voorhees & Sease

[57] ABSTRACT

This invention provides an oil well drilling or service rig having inclined capability with pipe handling means which will automatically retrieve pipe from a horizontal pipe rack, tilt it into a position parallel to the mast, and transpose it into the center line of the mast in line with the drill string and stab the pipe into the drill string for make-up while the elevators are being moved into position to lower the string. The pipe handler can also be used to withdraw pipe from the string in the reverse operation.

6 Claims, 8 Drawing Sheets

4
C
D
70
B
44
A
7

OIL WELL RIG WITH PIPE HANDLING APPARATUS

This invention relates to rigs used in oil well operations. Although it is primarily directed to service rigs used in the maintenance and overhaul of existing oil wells, it might also be adapted to use in association with rigs for drilling new oil wells. In particular, this invention relates to a rig capable of operating at various angles between horizontal and vertical, which is a feature more commonly in use now than in the past. Specifically, this invention is directed to a rig which has special means for handling pipe during the procedure of "tripping" pipe into or out of the well or hole.

While the operation of drilling an oil well has long been performed automatically by a drilling rig, there are operations in connection with oil well drilling or oil well servicing which require a great deal of non-productive time and man power. In the case of a drilling rig it is frequently necessary to pull the drill string out of the hole ("tripping out") to replace the bit and to run the drill pipe back into the hole. In an existing oil well it is frequently necessary to pull out a string of production pipe to service the well or maintain downhole equipment. In either case this involves a long series of repetitive steps in which joints of pipe are withdrawn from the hole, (one or two or three at a time), disconnected by "breaking out" their threaded ends, and stored while subsequent lengths are withdrawn. The process is repeated in reverse when lengths of pipe are connected ("made up") together and inserted one after another to replace the drill string or the production string in the hole.

These operations are costly and time-consuming because they represent hours when the rig is not drilling or the well is not producing, and have traditionally required additional employees to handle the pipe joints being made up or inserted (brokenout). It is therefore desirable to provide means by which pipe may be handled more quickly and automatically.

It is therefore the purpose of this invention to provide a drilling rig, especially one designed to operate at various angles from the vertical, having means which can handle pipe (by which is meant drill or production pipe or the like) from a storage position (which typically means lying horizontal on racks beside the rig), and lift and place the said pipe into a position in line with lengths of pipe already in the well or drill hole, and facilitate the stabbing of the lengths of pipe into the threaded connection of the next preceding pipe so that it can be joined by rotating.

Alternatively, it is the purpose of this invention to provide a rig which will take drill pipe removed from the hole, disconnect it from the string and remove it from the mast and place it in the storage device or pipe rack.

Unlike previous devices designed to speed up the tripping operation, the present invention is designed to provide greater speed, efficiency and lower costs, by providing an automatic pipe handling mechanism which will pick up pipe in the horizontal position, tilt it to an angle parallel to the rig mast, transpose the pipe into the centre of the mast in alignment with the centre line of the well and then move the pipe longitudinally to "stab" the joint into the upper end of the top joint of the string emerging from the hole so that the pipe threads may be connected. This pipe handling feature allows the length of pipe being added to the string to be connected while the elevators of the rig are being raised so as to perform two functions at once and diminish the time wasted.

Similarly, when a string is being removed from a hole or well, the pipe handler may be positioned to grab the pipe as soon as it is disconnected from the string while the elevators are being lowered to grip onto the next lower joint of pipe. In this way the disconnected length can be lifted out of the mast and put into the storage facility or pipe rack while the elevators are being coupled to the next joint and while the elevators and hoisting mechanism are withdrawing another length of pipe from the hole.

These improvements and advantages can be provided by apparatus incorporating the present invention which comprises an oil well rig having a mast capable of operating in vertical or inclined positions, said mast having elevators adapted to lower or lift a string of pipe, slips adapted to suspend a string of pipe in the well, a torque wrench adapted to connect and disconnect threaded ends of adjacent lengths of pipe by relative rotation thereof, a loading arm mounted on the side of said mast and having clamp means adapted to grasp a length of pipe, means adapted to pivot said loading arm between a position in which said grasped pipe is horizontal and a position in which said grasped pipe is parallel to the inclination of said mast, means to rotate said loading arm about an axis parallel to said mast so as to transpose said grasped pipe from a position outside of said mast to a position inside of said mast in line with the axis of said well, means to move the said loading arm in a direction parallel to the axis of said pipe so as to stab said pipe into said pipe string and withdraw said pipe from said well.

Ideally, this apparatus would include a pivot axis perpendicular to the plane of inclination of the mast and a hydraulic cylinder on said loading arm spaced from said pivot axis to cause movement between the horizontal and the inclined or vertical position. The rotation of the loading arm may be achieved by a hydraulic cylinder which activates a rack and pinion mechanism designed to rotate the loading arm about an axis parallel to the inclination of said mast, and further hydraulic means designed to move the loading arm parallel to the axis of rotation so as to stab a length of pipe into the pipe string or remove it from the pipe string during operation.

Preferably, the apparatus is designed so that during operations to remove pipe from the well, the pipe string can be hoisted until one or more lengths of pipe are withdrawn and the slips are set on the remainder of the drill string. The elevators are then lowered over the pipe joints to be removed while the torque wrench is disconnecting the threaded connection. When the elevators are approximately two-thirds of the way down the pipe joint, the loading arm is brought into position to grip the length of pipe and remove it as soon as the elevators are lowered beneath the bottom connection. The loading arm is then used to withdraw the length of pipe axially, rotate and transpose it out of the mast and tilt it down to the horizontal position for placement in the pipe rack, all of which can be done while the elevators are simultaneously being used to hoist the drill string to withdraw the next length of pipe. Similarly, the loading arm can be used to grasp length of pipe from the pipe rack, tilt it into the inclined position parallel to the mast, rotate it into the mast in line with the centre line of the well, and stab it into the end of the pipe string while running pipe into the well. The loading arm can be used to obtain another length of pipe from the pipe rack while the elevators are being raised to the top of the previous joint and the pipe string is being lowered.

The invention may be better understood by a description of one embodiment hereof with reference to the attached drawings in which.

Although the illustrated embodiments is described in terms appropriate to a service rig designed to perform maintenance operations on existing wells, similar features might be incorporated in a rig designed to drill new oil wells.

Figure 1:
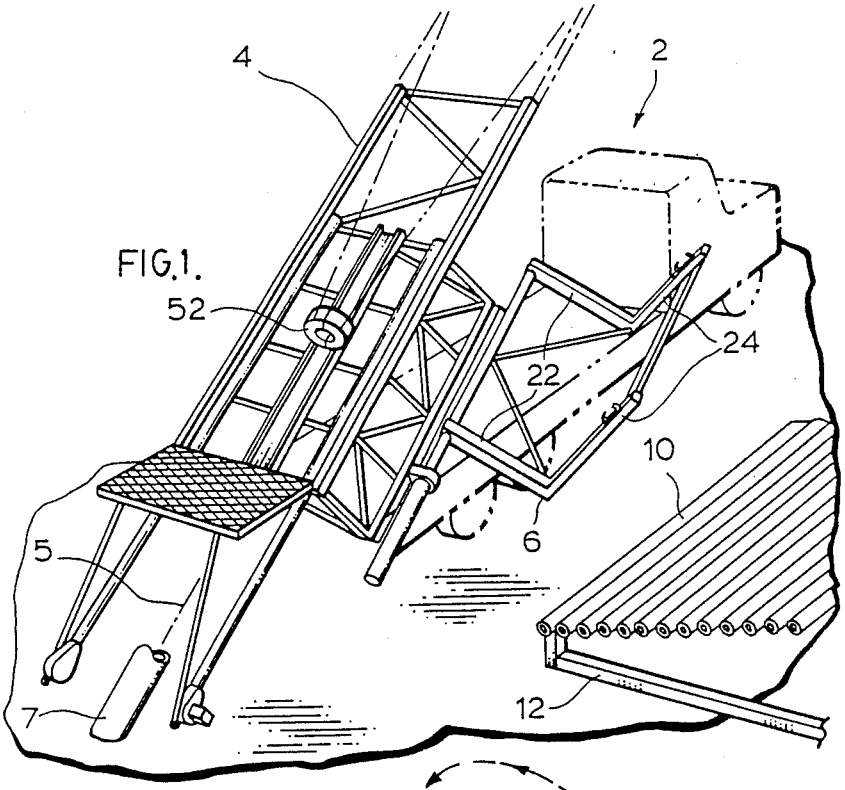
FIG. 1 is a perspective view of a mobile oil well service rig.
Figure 4:
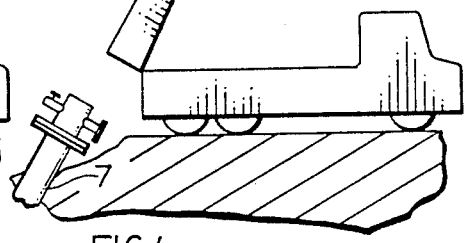
FIG. 4 shows the same rig in a slanted or inclined configuration.

In FIG. 1 a mobile oil well service rig 2 is illustrated having a mast 4 shown at an inclined position as might be appropriate for servicing an inclined oil well similar to the configuration shown in FIG. 4.

The mast is positioned and inclined so that its centre line 5 is aligned with the centre line of the well bore 7 so that drill pipe can be moved axially in and out of the hole.

A loading arm 6, shown mounted on the side of the mast, is designed to take lengths of pipe, such as 10, from the pipe rack 12 or replace them thereon.

When the rig is being used to put production pipe (or drill pipe) into the hole, the loading arm serves the purpose of taking each subsequent joint of pipe, such as 10, from the rack and placing it in line with the centre line of the hole so that it may be connected with the string of pipe already inserted and lowered into the hole ready to receive the next joint of pipe.

Figure 2:
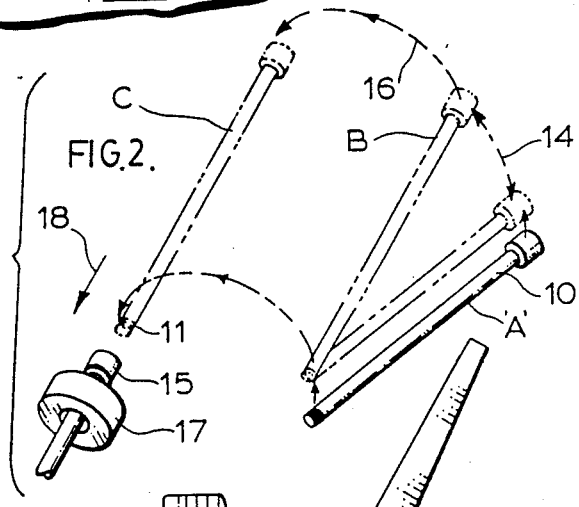
FIG. 2 illustrates a typical path of movement of a length, of pipe from storage on a pipe rack to insertion in the production string.

FIG. 2 illustrates the motion by which the pipe is taken from the rack and placed in the string being lowered in the well. In this drawing the typical length of pipe 10 is illustrated first of all in the horizontal position "A" on the pipe rack where it is received by the loading arm 6 (the details of which will be described later). By means of the loading arm, the pipe is then tilted (arrow 14) to position "B" in which the loading arm and the pipe 10 are parallel to the centre line of the mast. The loading arm is then swung about its axis to transport (arrow 16) the pipe 10 to the location "C" where it is still parallel to the mast but positioned in line with the centre line of the well. The pipe is then moved axially downward, as illustrated by the arrow 18, so that the lower threaded end 11 of the pipe 10 will stab into and engage the threaded upper end of the pipe string protruding from the hole and being held by the slips 17 of the rig.

Figure 5:
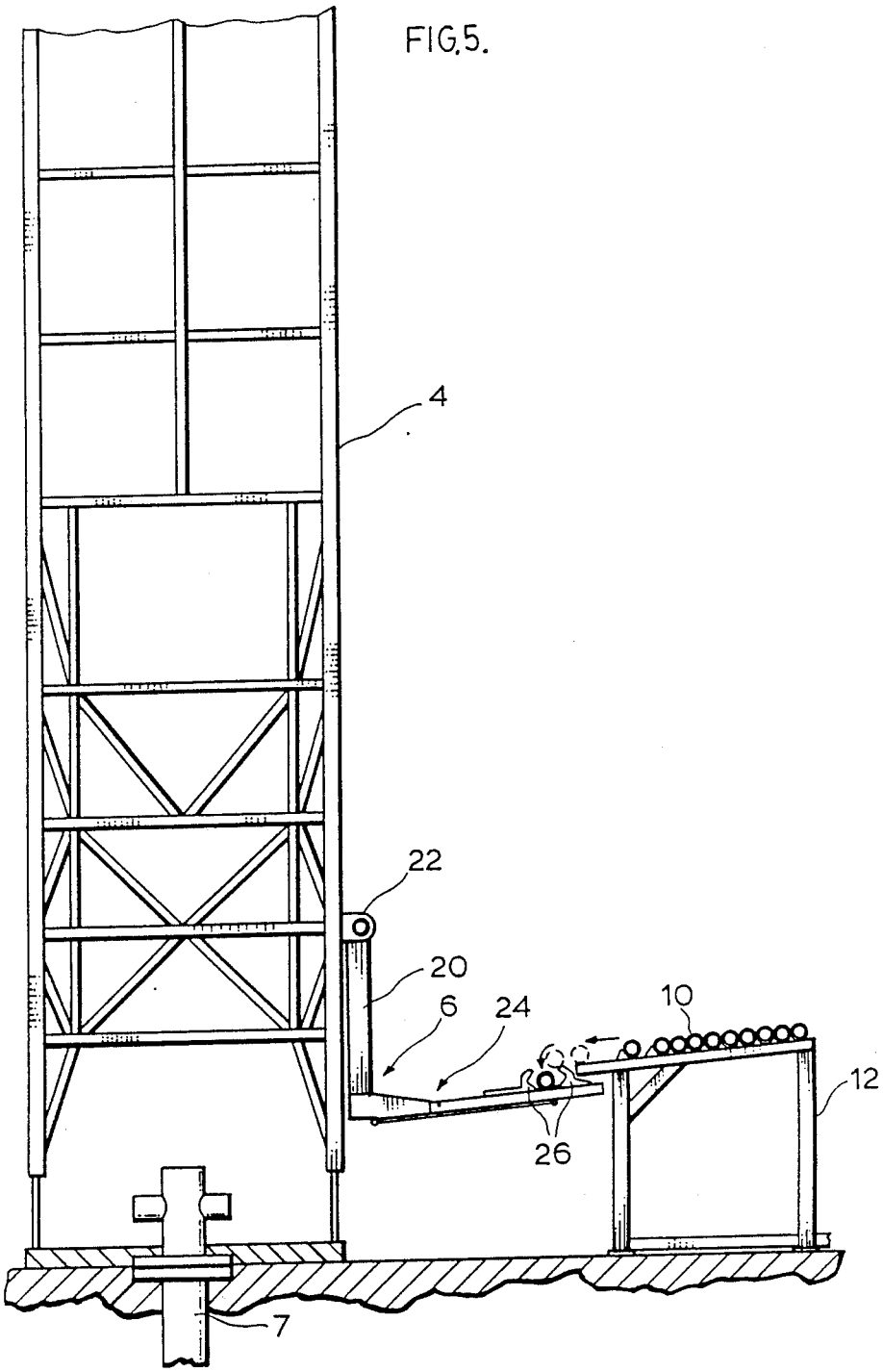
FIG. 5 shows the mast of the rig with a loading arm positioned to receive a new joint of pipe.

FIG. 5 illustrates the rig of FIG. 1 in greater detail in which the mast 4 has mounted on the side thereof a loading arm 6 having an upper arm 20 pivotally and rotatably mounted to the mast at 22. The arm has a lower arm 24 with a set of clamps 26 designed to grasp a single joint of pipe received from the pipe rack 12, where a number of lengths of pipe, such as 10, are stored.

In fact the loading arm 6 comprises a pair of similar upper arms 20 and lower arms 24, each with a pair of clamps 26, so that the pipe length is grasped ideally on either side of the midpoint for better handling and balance.

In the illustration of FIG. 5 the next length of pipe 10 is shown having just been received in the clamp 26 while subsequent lengths of pipe are restrained by mechanisms which are known to those skilled in the art and not a feature of the present invention.

Figure 6:
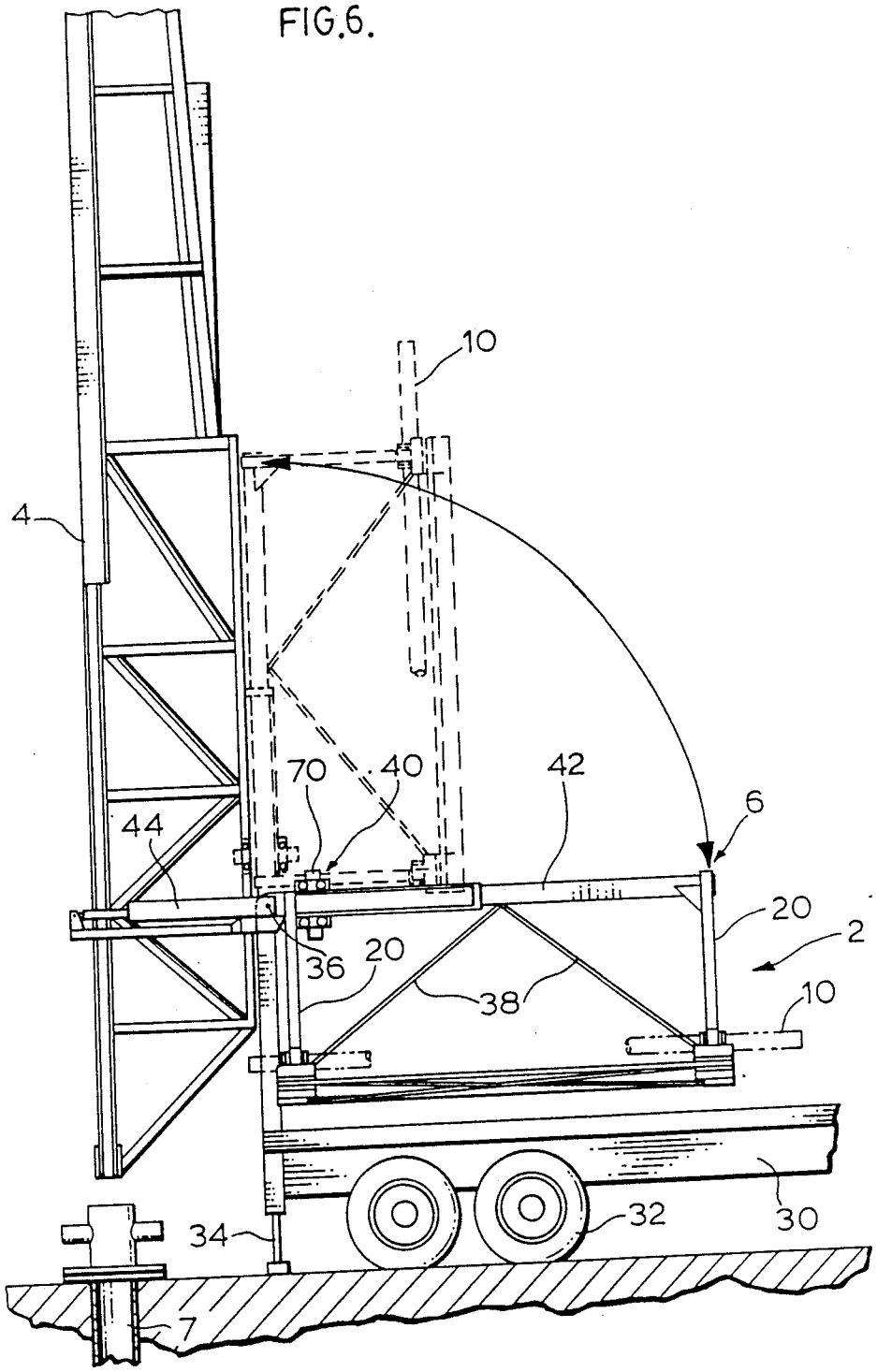
FIG. 6 shows the mast of the rig and the loading arm movable between a horizontal position and a position parallel to the mast.

In FIG. 6 the chassis of the mobile rig 2 is shown at 30 supported for transportation on wheels 32 and supported for better stability during operations by legs or jacks schematically illustrated at 34.

Figure 3:
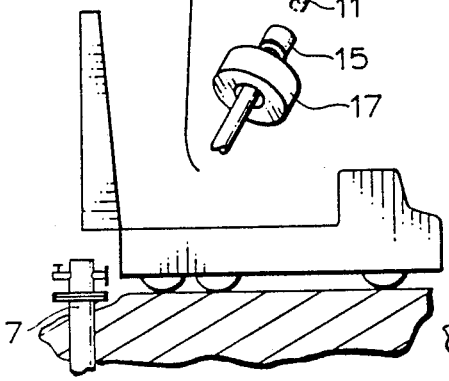
FIG. 3 shows the vertical configuration of the rig used in a vertical oil well.

FIG. 6 illustrates the mast 4 in side elevation, as shown in FIG. 3. In this illustration the loading arm 6 is shown in solid lines in the horizontal position with the upper arms 20 in the vertical and the pipe 10 in the horizontal position.

Also illustrated in FIG. 6 in dotted lines is the position of the loading arm tilted up about the pivot axis at 36 so that the pipe 10 is parallel to the mast. Although the mast is shown in the vertical position in this illustration, it could well be at some inclined angle such as 30° or 45° from the vertical. Whatever the tilt of the mast may be, the loading arm is designed to raise the length of pipe 10 into a position parallel to that angle.

Also shown in this illustration are cross members 38 which give stability and strength to the loading arm.

Also shown in FIG. 6 is a bearing 40 permitting the loading arm to rotate about an axis concentric with the shaft 42 which will be described in greater detail later.

Figure 7:
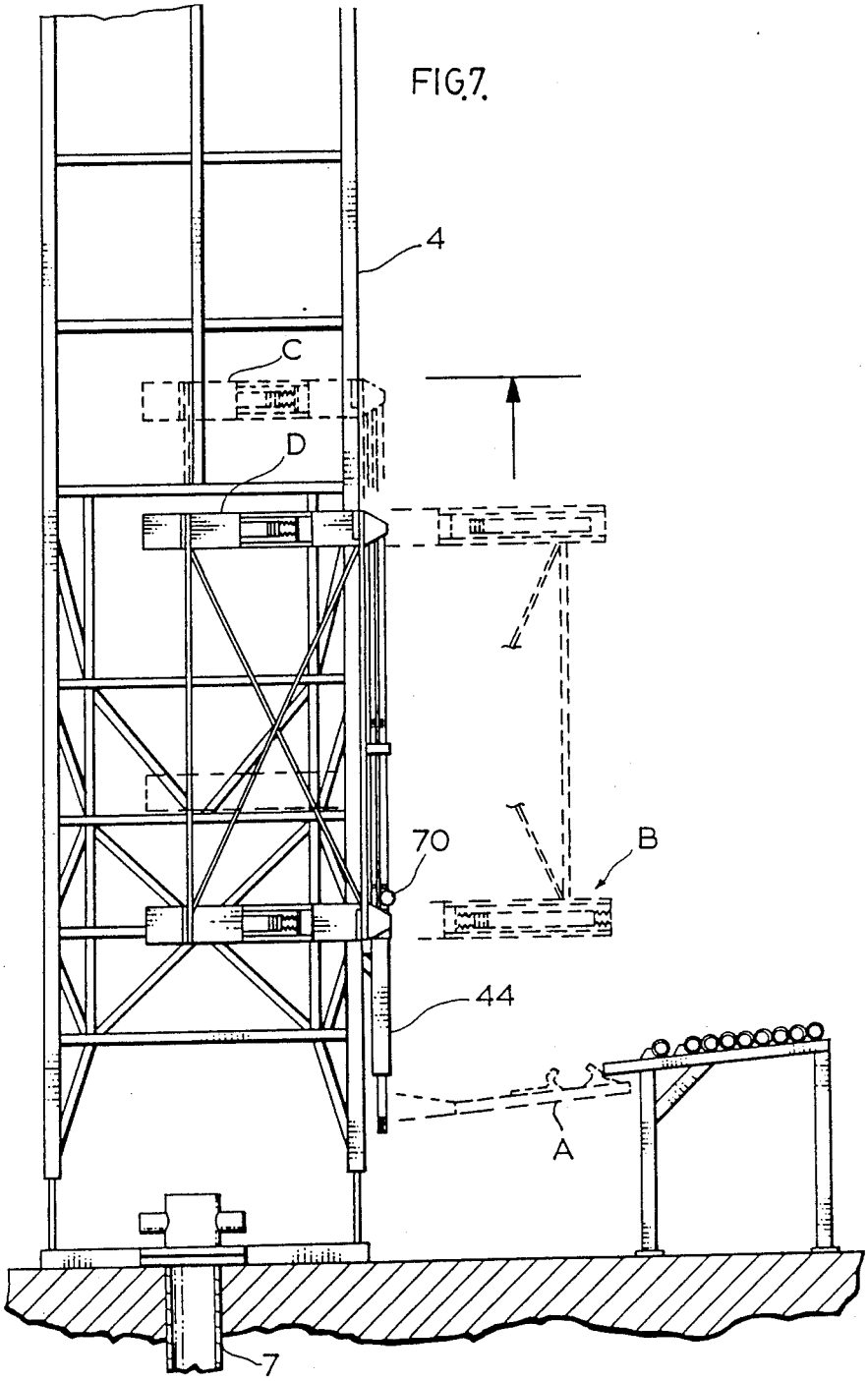
FIG. 7 illustrates the trans-position of the pipe joint from a position outside but parallel to the mast to a position in line with the centre line of the well.

In FIG. 7 the mast 4 is illustrated from a rearward view similar to the view in FIG. 5. The loading arms in position to receive the next length of pipe are shown as in FIG. 5, but in dotted lines. The loading arms are also shown in dotted lines in the position tilted up parallel to but outside of the mast, as described in connection with FIG. 6.

In solid lines in FIG. 7 the loading arms are illustrated after having been rotated rearwardly and inwardly to position the pipe 10 in the mast in line with the centre line of the well 7. As previously mentioned, the tilting function is accomplished by pivoting about the axis 36 and the rotation is achieved by rotating the arms about the axis of the bearing 40.

Figure 8:
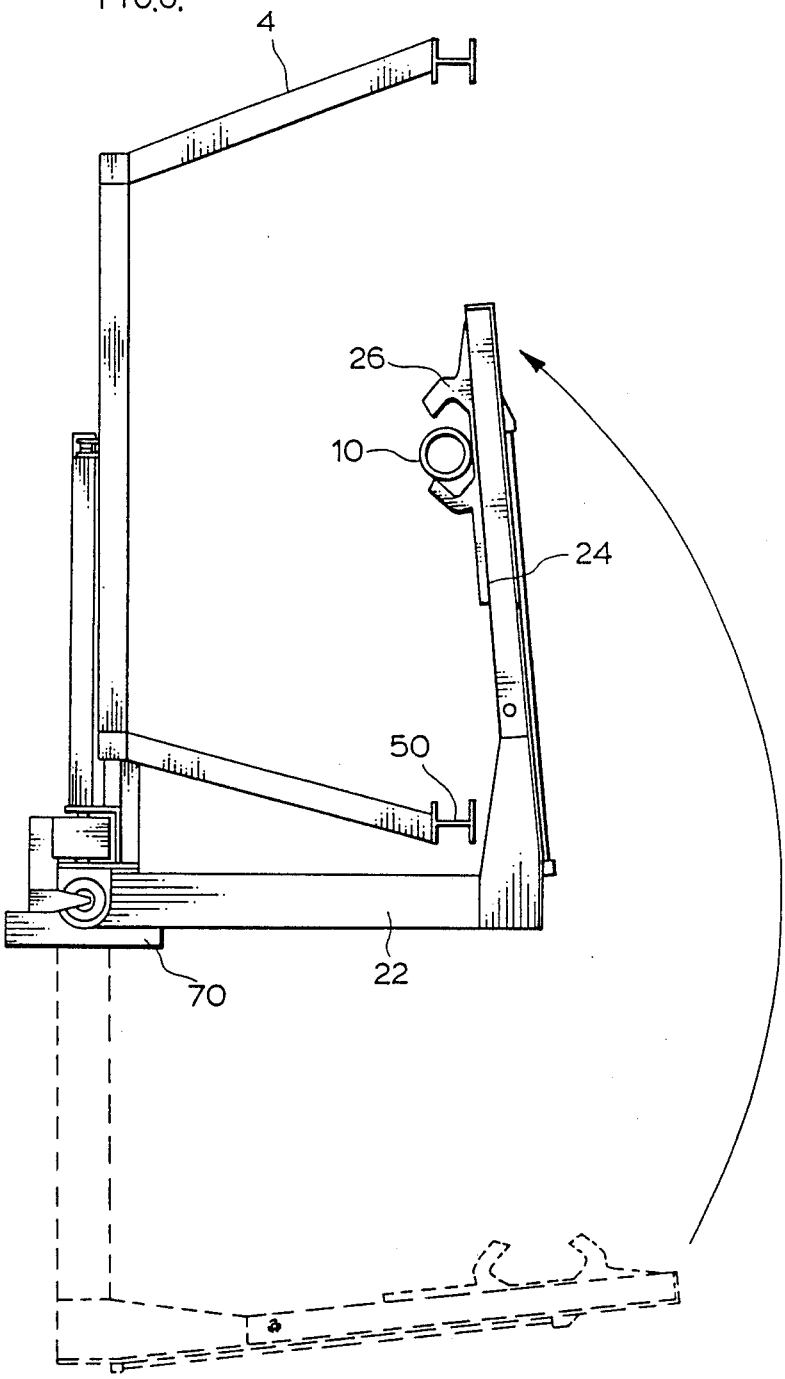
FIG. 8 is a plan view showing the motion of the loading arm illustrated in elevation in FIG. 7.

FIG. 8 illustrates the mast 4 shown in plan view with the open side facing rearward so that the clamps 26 of the lower arm 24 connected to the upper arm 22 may be rotated around the mast leg 50 from the position illustrated in dotted lines (namely, outside of but parallel to the mast, as seen in FIG. 6) to the position shown in solid lines where the pipe 10 held in the clamps 26 is lined up with the centre line of the well and the drill string being run in the hole.

Returning to FIG. 7, the position of the loading arms at "C" illustrates the position of the pipe before it is engaged with the drill string. The solid line position "D" shown in FIG. 7 illustrates the position of the loading arms after the pipe has been advanced downwardly to engage the drill string by means of the hydraulic cylinder 44, which operates to move the loading arm in a direction parallel to the axis of the rig and effect the stabbing or disengaging motion of the length of pipe held by the clamps 26. Of course the hydraulic cylinder 44 tilts about axis 36 with the loading arm and remains parallel to pipe 10.

A rig having conventional equipment and provided with the apparatus described above can be used effectively to make tripping more efficient and less time-consuming or costly.

The tripping out procedure is performed as follows:

First of all, the string of pipe in the hole is hoisted out using the elevators 52 (which are conventional devices used to grasp the pipe by the enlarged diameter at the upper end and are moved vertically by hydraulic or cable means well known in oil rig design), until one length of pipe (or two or three if the mast is high enough) is out of the hole and the slips 17 are set to hold the joint of pipe below. The elevators are then lowered over the top joint of the pipe to be removed. A torque wrench (not shown) is used to spin out the connection (11–15) while lowering the elevators. When the elevators are approximately two-thirds of its way down the pipe handler or loading arm is brought into position to grip the length of pipe 10. As soon as the elevators are lowered over the bottom coupling in a position to lift the next joint, the loading arm is then used to unstab (the reverse of arrow 18) the top joint and remove it from the mast, tilt it down to the horizontal position, and place it in the pipe rack. The elevators are simultaneously used to hoist the string to position for removing the next length of pipe. In this procedure the pipe handler can be brought into position while the elevators are still moving down to, and over, the lower coupling so that as soon as the elevators are in position, the pipe handler can remove the disconnected joint of pipe.

In the tripping-in operation the equipment is used as follows. The string of pipe is lowered with the elevators until the top thread is above the well and the slips are set to hold the string. The pipe handler is then used to bring the next length of pipe 10 from the pipe rack into position and stab it into the lower joint, as which point the length of pipe is supported by the mast and the loading arm can be unfastened and removed to a position ready to grab the next length of pipe from the pipe rack.

Meanwhile the elevators are allowed to pass over the coupling and are raised up to the top of the newly positioned joint of pipe. While raising the elevators the pipe connection is made up by means of the torque wrench. As the elevators reach the top they grip the top of the new joint and the string is lifted out of the slips, the slips are open and the elevators are used to lower the string one pipe length into position to receive the next length of pipe. In this operation the loading arm can be retracted to receive another length of pipe from the pipe rack while the elevators are being raised and the string is being lowered.

Similar operations can be conducted for a drilling rig in which case the top drive would normally be removed out of position while tripping-in or tripping-out.

Figure 9:
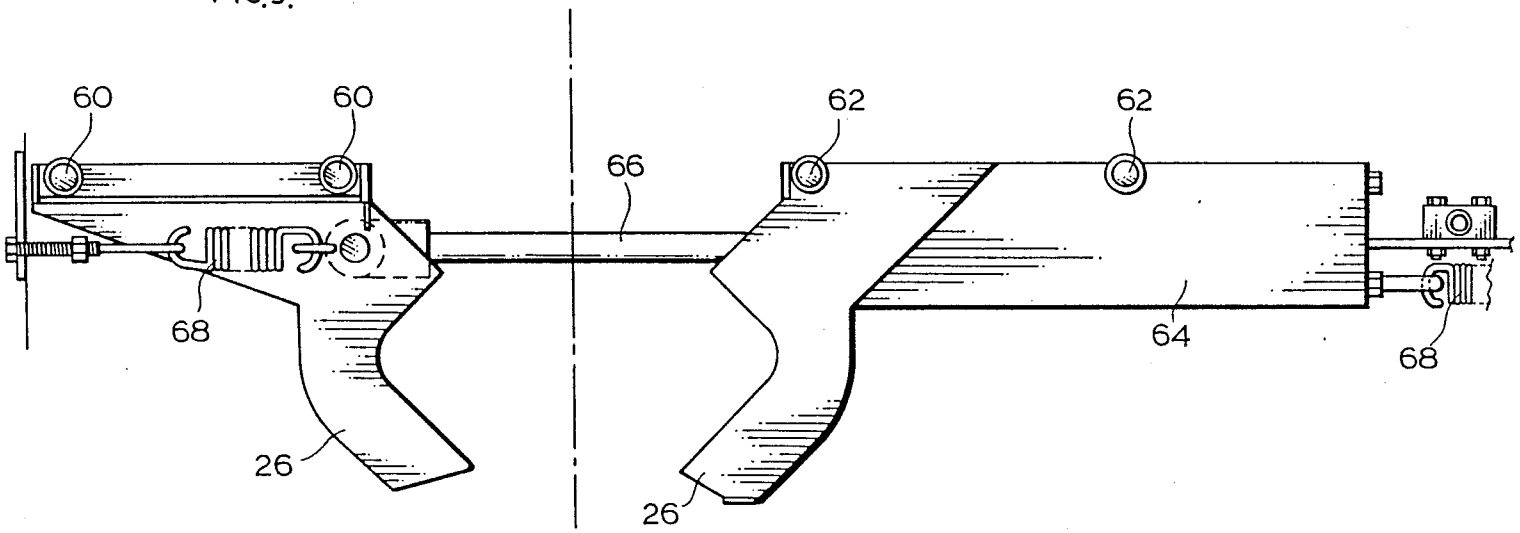
FIG. 9 is a cross sectional view of the functional features of the loading arm pipe clamps.

The function of the clamps is illustrated in FIG. 9 in which the opposing jaws 26 are designed to run in a track along the arm 24 by means of rollers 60 and 62 respectively. The jaws 26 are caused to open or close by means of a hydraulic cylinder 64 and its piston rod 66 which adjustably extend between the two jaws of the clamp. Ideally, the jaws should be restrained so that they close about the centre line by means, such as the springs 68, so that the pipe held in the jaws of the clamp will be aligned with the centre line of the hole and the pipe string when a joint of pipe is being stabbed in or withdrawn from the string.

The rotational movement of the arms, as illustrated in FIG. 8, is achieved, in the preferred embodiment illustrated, by a rotary actuator 70 located adjacent to the rotational axis of the loading arm, as seen in FIGS. 6, 7 and 8. This rotary actuator comprises an elongated hydraulic cylinder in which hydraulic pressure exerted from either end will cause a rack to move longitudinally thereby rotating a pinion gear to which it is engaged, thus effecting rotational movement of the arm about the rotational axis at the mounting 22.

Figure 10:
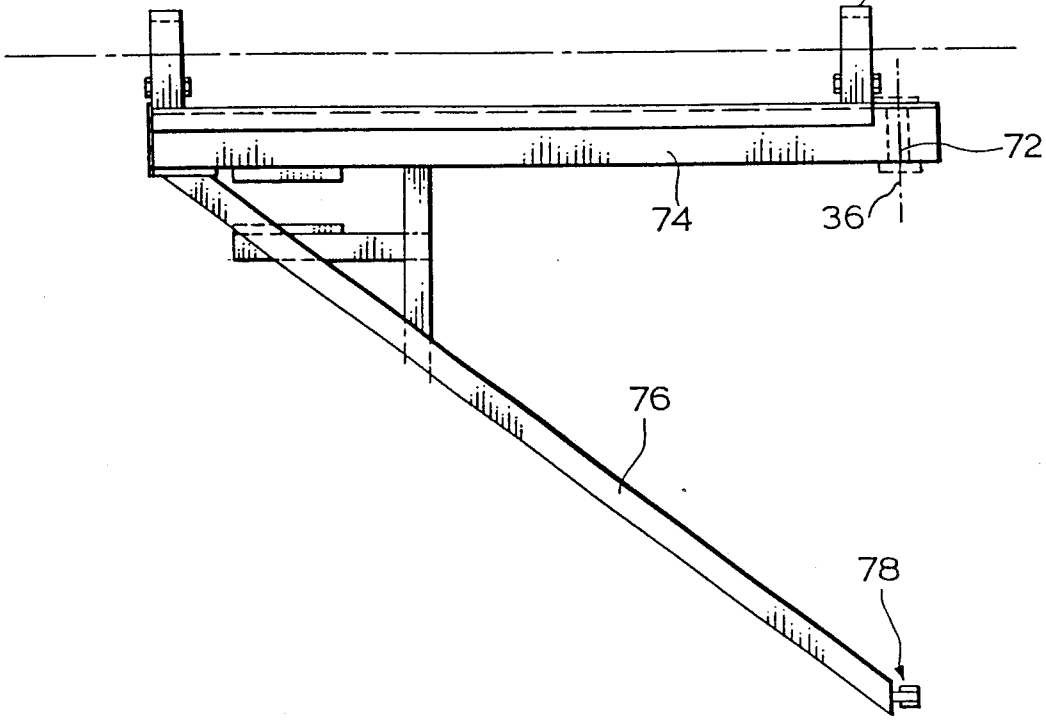
FIG. 10 is a plan view of the means by which the loading arms are pivotally mounted adjacent the mast.
Figure 11:
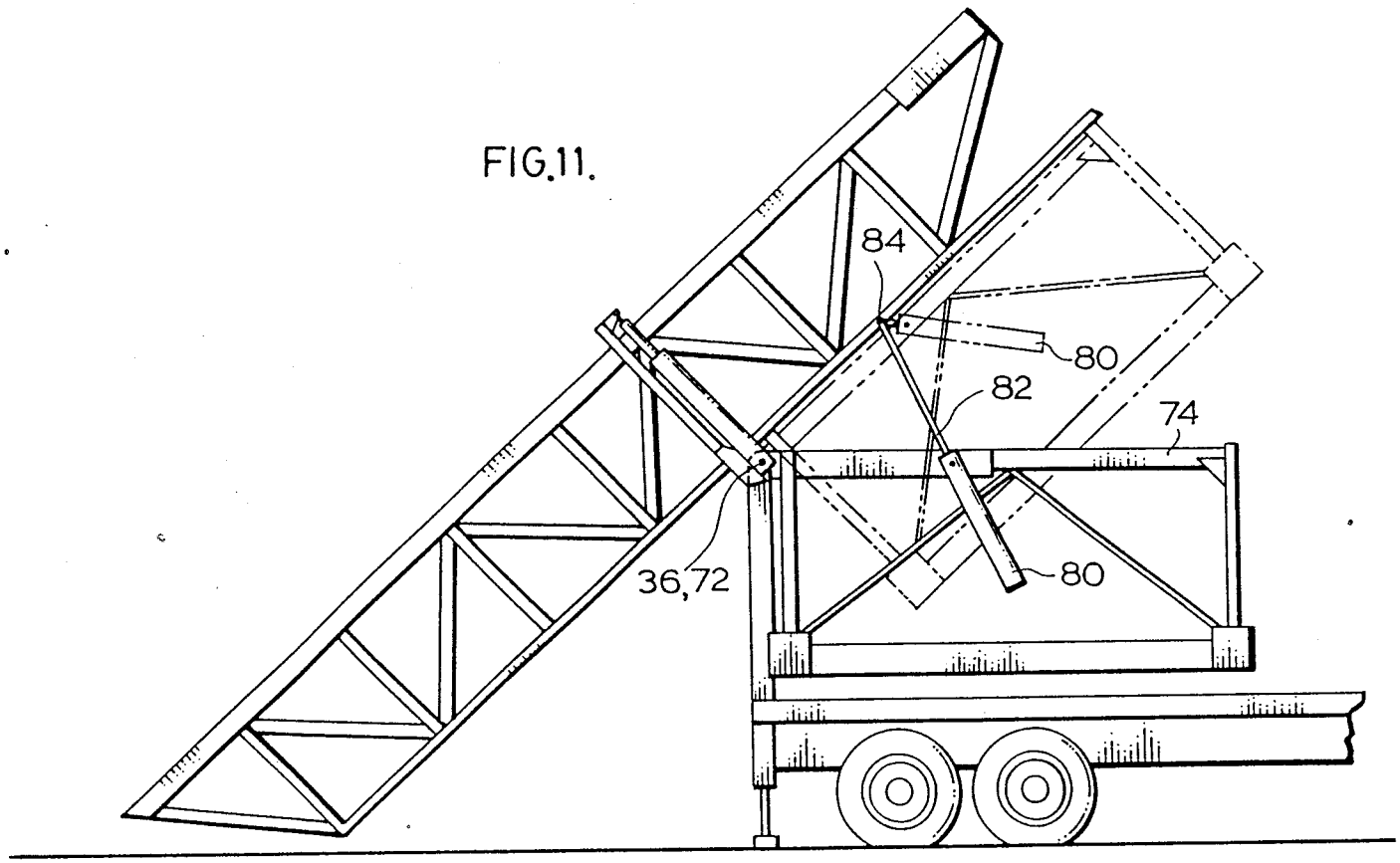
FIG. 11 is an elevation view of the means by which the loading arms are pivoted.

FIG. 10 illustrates the mounting of the loading arm to the mast in which the centre line of rotation is illustrated at the mounting 22. The pivoting motion is permitted by the pin 72 in the support arm 74 which supports the loading arm. The pivot pin 72 provides the axis of pivot 36, illustrated in FIG. 6. Lateral stability is provided by the strut 76 which is fastened to pivot about the same axis at 78. The mechanism by which the loading arm is pivoted from the horizontal to the inclination of the rig mast is shown in elevation in FIG. 11. The support arm 74 is caused to pivot about the axis 36 of the pin 72 by a hydraulic cylinder 80 having a piston rod 82 pivotally fastened at its other end to the mast at 84. In this arrangement the hydraulic cylinder is fully retracted when the loading arm (shown in dotted lines) is parallel to and adjacent to the mast. Therefore, the pipe arm will always pivot to a position parallel to the mast, and no further, at whatever inclination the mast may be set. The loading arm can be returned to the horizontal under the force of gravity when the hydraulic cylinder pressure is released or by the controlled effort of the hydraulic cylinder in the opposite direction, if desired.

By means of the apparatus described above, the functions of tripping-out and tripping-in can be handled with less man power because of the automated nature of the loading arm and considerable time is saved by virtue of the fact that the elevators can operate in moving the string simultaneously while the pipe handler is moving a length of pipe into or out of the pipe rack. In other words the function of the elevators is separated from and can be operated at least partially simultaneously with the operation of the loading arm so that less time is wasted. The design of the loading arm which permits it to perform the stabbing operation allows the connection to be made up or between while the elevators are being raised or lowered at the same time.

It will, of course, be realized that modifications and variations of the preferred embodiment disclosed can be employed without departing from the inventive concept herein.

I claim:

1. A rig of the type adapted to drill or service oil wells comprising:

a mast capable of alignment with said oil well;

elevators adapted to lift or lower a string or pipe protruding from said oil well along a portion of the length of said mast;

slips adapted to hold said pipe string in a position protruding from said hole;

torque wrench means adapted to rotate adjacent joints of pipe relative to each other to connect or disconnect said joints or pipe;

pipe handling means mounted laterally adjacent to said mast comprising a pair of loading arms and having clamp means on said loading arms adapted to grasp a joint of pipe;

means to pivot said loading arms between a first position in which said loading arm clamps are horizontally aligned in a position adapted to receive a joint of pipe located laterally adjacent said mast to a second position in which said loading arm clamps are aligned parallel to the longitudinal dimension of said mast;

means to rotate said loading arms about an axis parallel to said mast to move said clamp means from a position at one side of said mast to a position within said mast aligned with said well;

means to move said loading arm clamps in a direction of their alignment in line axially with said well;

said axial movement means, said rotational means, and said pivot means, and said grasping means being capable of operating in the reverse direction and in the reverse order.

2. Apparatus as claimed in claim 1 in which said pipe handling means are mounted to said mast by a pin having a horizontal axis and a hydraulic cylinder means extending between said pipe handling means and said mast.

3. Apparatus as claimed in claim 2 in which rotating means comprises a rotary actuator comprising a hydraulic cylinder adapted to move longitudinally a rack coupled to a pinion coupled to a means rotatably mounting said loading arms to said mast about an axis parallel to the alignment of said clamps.

4. Apparatus as claimed in claim 2 in which means to move axially comprises a hydraulic cylinder adapted to move said loading arms axially in a direction parallel to the axis of rotation thereof.

5. Apparatus as claimed in claims 1, 2 or 3 in which the loading arm clamps may be moved into position in alignment with the well while the drill string is held by the slips and the elevators are being lowered, and the loading arm may be employed to grasp a joint of pipe in the mast and withdraw it from the mast and place it to one side of the rig while elevators are being used to raise the drill string.

6. Apparatus as claimed in claims 1, 2 or 3 in which said loading arms may be used to grasp a length of pipe stored to one side of the rig, tilt it parallel to the mast, rotate it to transport the pipe into the mast while the elevators are being raised and used to lower the pipe string.

* * * * *